US009273688B2

(12) United States Patent
Sasaki et al.

(10) Patent No.: US 9,273,688 B2
(45) Date of Patent: Mar. 1, 2016

(54) PUMP ROTOR AND INTERNAL GEAR PUMP USING THE SAME

(71) Applicant: SUMITOMO ELECTRIC SINTERED ALLOY, LTD., Okayama (JP)

(72) Inventors: Harumitsu Sasaki, Itami (JP); Kentaro Yoshida, Itami (JP)

(73) Assignee: SUMITOMO ELECTRIC SINTERED ALLOY, LTD., Okayama (JP)

( * ) Notice: Subject to any disclaimer, the term of this patent is extended or adjusted under 35 U.S.C. 154(b) by 85 days.

(21) Appl. No.: 14/345,395

(22) PCT Filed: Feb. 28, 2013

(86) PCT No.: PCT/JP2013/055271

§ 371 (c)(1),
(2) Date: Mar. 17, 2014

(87) PCT Pub. No.: WO2013/157306

PCT Pub. Date: Oct. 24, 2013

(65) Prior Publication Data

US 2014/0341769 A1 Nov. 20, 2014

(30) Foreign Application Priority Data

Apr. 17, 2012 (JP) ..... 2012-093767

(51) Int. Cl.
*F03C 2/00* (2006.01)
*F03C 4/00* (2006.01)
(Continued)

(52) U.S. Cl.
CPC . *F04C 2/10* (2013.01); *F01C 1/084* (2013.01); *F01C 1/103* (2013.01); *F04C 2/084* (2013.01); *F04C 2/102* (2013.01); *F04C 2270/13* (2013.01); *F04C 2270/16* (2013.01)

(58) Field of Classification Search
CPC ..... F04C 2/102; F04C 2/084; F04C 2/086; F04C 2/10; F04C 1/084; F04C 1/086; F01C 1/103; F01C 1/084; F01C 1/086
USPC ..... 418/166, 171, 61.3, 150
See application file for complete search history.

(56) References Cited

U.S. PATENT DOCUMENTS

| | | | | |
|---|---|---|---|---|
| 5,772,419 | A | 6/1998 | Hansen et al. | |
| 2010/0209276 | A1* | 8/2010 | Uozumi et al. | 418/150 |
| 2012/0177525 | A1* | 7/2012 | Uozumi et al. | 418/150 |

FOREIGN PATENT DOCUMENTS

| | | | |
|---|---|---|---|
| CN | 1442615 | A | 9/2003 |
| CN | 1816694 | A | 8/2006 |

(Continued)

OTHER PUBLICATIONS

European Office Action for related European Application No. 13777471.7—1608 dated Jun. 16, 2015, 6 pages.

(Continued)

*Primary Examiner* — Theresa Trieu
(74) *Attorney, Agent, or Firm* — Ditthavong & Steiner, P.C.

(57) ABSTRACT

A tooth profile of an inner rotor 2 is formed by an envelope of a group of circular arcs of a locus circle C having a center on a trochoidal curve TC. The envelope of the group of circular arcs is formed by rolling a rolling circle having a predetermined diameter along a base circle without slipping and drawing the trochoidal curve TC based on a point distant from the center of the rolling circle by a distance equivalent to an amount of eccentricity between the two rotors. A diameter $d_2$ of the locus circle C is constant until one point between an addendum point and a dedendum point of the inner rotor and changes from the one point such that a diameter $d_{2B}$ at the dedendum point becomes larger than a diameter $d_{2T}$ at the addendum point of the inner rotor.

4 Claims, 4 Drawing Sheets

(51) Int. Cl.

| | |
|---|---|
| ***F04C 2/00*** | (2006.01) |
| ***F04C 2/10*** | (2006.01) |
| ***F04C 15/00*** | (2006.01) |
| ***F04C 2/08*** | (2006.01) |
| ***F01C 1/10*** | (2006.01) |
| ***F01C 1/08*** | (2006.01) |

(56) References Cited

FOREIGN PATENT DOCUMENTS

| | | | |
|---|---|---|---|
| CN | 101627209 | A | 1/2010 |
| CN | 101821510 | A | 9/2010 |
| EP | 0779432 | A1 | 6/1997 |
| EP | 2206923 | A1 | 7/2010 |
| JP | 61-201892 | A | 9/1986 |
| JP | 2008138601 | A | 6/2008 |
| JP | 2010-151068 | A | 7/2010 |
| WO | 2005005835 | A1 | 1/2005 |
| WO | 2008111270 | A1 | 9/2008 |
| WO | 2010016473 | A1 | 2/2010 |

OTHER PUBLICATIONS

International Search Report of corresponding International Application PCT/JP2013/055271, dated May 21, 2013, 1 page.
Chinese Office Action for related Chinese Patent Application No. 201380003081.4 dated Sep. 25, 2015, 17 Pages.

* cited by examiner

PUMP ROTOR AND INTERNAL GEAR PUMP USING THE SAME

TECHNICAL FIELD

The present invention relates to a pump rotor formed by combining an inner rotor (external gear) and an outer rotor (internal gear) between which a difference in the number of teeth is one, and to an internal gear pump formed by fitting the pump rotor within a housing.

BACKGROUND ART

Internal gear pumps are used as, for example, pumps for lubricating engines and automatic transmissions (AT) in vehicles. One known type of such an internal gear pump is formed by combining an inner rotor and an outer rotor, between which a difference in the number of teeth is one, and disposing the rotors eccentrically relative to each other. Furthermore, in another known pump of this type, the tooth profile of the rotors is formed by using a trochoidal curve, which is known for good volume efficiency, low noise, and low drive torque.

A tooth profile formed by using this trochoidal curve is formed in the following manner. First, as shown in FIG. 5, a rolling circle B rolls along a base circle A without slipping, and a trochoidal curve TC is drawn by a locus of a point on a radius distant from the center of the rolling circle B by a distance e (=amount of eccentricity between rotation centers of the inner rotor and the outer rotor). Then, the tooth profile of the inner rotor 2 is formed by an envelope of a group of circular arcs of a locus circle C having a fixed diameter and whose center is located on the trochoidal curve TC (also see Patent Literature 1 below).

In a pump having a tooth profile using such a trochoidal curve, an amount E of eccentricity between the center of the inner rotor and the center of the outer rotor is regulated for ensuring the face width and for designing the tooth profile. Therefore, an increase in the tooth height is limited, making it difficult to fulfill demands for increasing the discharge rate. The present applicant has made a proposition in Patent Literature 2 below in which the tooth height can be freely set in a pump rotor of the aforementioned type.

CITATION LIST

Patent Literature

PTL 1: Japanese Unexamined Patent Application Publication No. 61-201892

PTL 2: Japanese Unexamined Patent Application Publication No. 2010-151068

SUMMARY OF INVENTION

Technical Problem

In the internal gear pump having the rotors in Patent Literature 2, the capacity of a pump chamber formed between the teeth of the inner rotor and the outer rotor can be increased by increasing the tooth height of the rotors. Although this achieves high discharge performance, noise caused by, for example, gear rattling increases.

The inner rotor whose tooth profile is formed based on the method according to claim 2 in the same literature has narrow addenda. Thus, addendum abrasion tends to occur easily.

An object of this invention is to reduce noise and suppress addendum abrasion in the pump proposed in Patent Literature 2 by devising the method for forming the tooth profile of the inner rotor.

Solution to Problem

In order to achieve the aforementioned object, in an internal gear pump according to the present invention that is forming by combining an inner rotor having n teeth and an outer rotor having (n+1) teeth, the rotors are formed in the following manner.

Specifically, when a rolling circle having a diameter $d_1$ is rolled along a base circle having a diameter d without slipping and a trochoidal curve is drawn by a point distant from a center of the rolling circle by a distance e, a tooth profile of the inner rotor is formed by an envelope of a group of circular arcs of a locus circle having a diameter $d_2$ and having a center on the trochoidal curve. The diameter $d_2$ of the locus circle is constant until one point between an addendum point and a dedendum point of the inner rotor and changes from the one point such that a diameter $d_{2B}$ at the dedendum point becomes larger than a diameter $d_{2T}$ at the addendum point.

The diameter $d_2$ of the locus circle (C) may change so as to satisfy the following expression:

$$d_2\theta = d_{2T} + (d_{2B} - d_{2T}) \times (\theta - \theta s)/(\theta e - \theta s) \qquad \text{Expression (1)}$$

where θ denotes an angle between the addendum point and the center of the locus circle, $d_2\theta$ denotes a diameter of the locus circle C at the angle θ, $d_{2T}$ denotes a diameter of the locus circle C at the addendum point of the inner rotor, $d_{2B}$ denotes a diameter of the locus circle C at the dedendum point of the inner rotor, θe denotes an angle between the addendum point and the dedendum point of the inner rotor and is determined from 180°/n, and θs denotes an angle from the addendum point of the inner rotor to a position where the diameter $d_2$ of the locus circle C begins to change (θe≠θs).

A ratio of a diameter $d_{2T}$ of the locus circle C at the addendum point of the inner rotor to a diameter $d_{2B}$ at the dedendum point preferably satisfies a condition $d_{2T}/d_{2B}>0.9$.

Furthermore, the angle θs is preferably set between 5% and 40% of an angle θe between the addendum point and the dedendum point of the inner rotor.

The present invention also provides an internal gear pump formed by accommodating a pump rotor within a rotor chamber provided in a housing. The pump rotor is formed by combining an inner rotor having the aforementioned tooth profile with an outer rotor whose tooth profile is formed by an envelope of a group of tooth-profile curves of the inner rotor, the envelope of the group of tooth-profile curves being formed by revolving a center of the inner rotor around a circle having a diameter (2E+t) and coaxial with a center of the outer rotor, and rotating the inner rotor 1/n times while the center of the inner rotor makes one revolution around the circle.

In the above description, E denotes an amount of eccentricity between the inner rotor and the outer rotor, t denotes a maximum clearance (tip clearance) between addenda of the outer rotor and the inner rotor pressed against the outer rotor, and n denotes the number of teeth of the inner rotor. The amount E of eccentricity between the inner rotor and the outer rotor is as follows: $E=e+(d_{2B}-d_{2T})/4$.

Advantageous Effects of Invention

The present invention can reduce noise and suppress addendum abrasion by devising the method for forming the tooth profile of the inner rotor.

DESCRIPTION OF EMBODIMENTS

Figure 1:
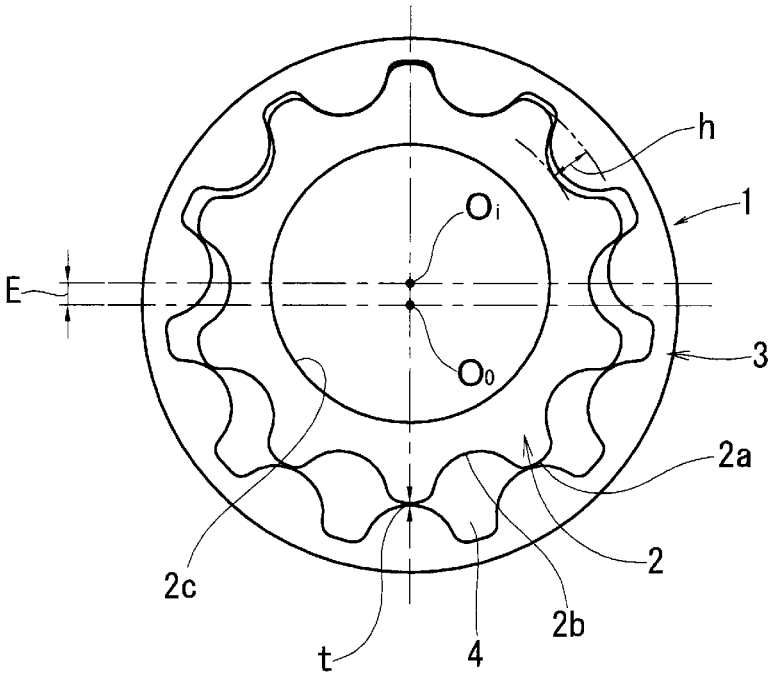
FIG. 1 is an end-surface diagram illustrating an example of a pump rotor according to this invention.

An embodiment of a pump rotor 1 according to this invention will be described below with reference to FIGS. 1 to 3. The pump rotor 1 shown in FIG. 1 is formed by combining an inner rotor 2 having n teeth (n=10 in the drawings) and an outer rotor 3 having (n+1) teeth. Reference character 2*a* denotes an addendum point of the inner rotor 2, and reference character 2*b* denotes a dedendum point of the inner rotor 2. The inner rotor 2 has a shaft hole 2*c* in the center thereof.

The inner rotor 2 has a tooth profile that is formed by an envelope described with reference to FIG. 5. Specifically, a rolling circle B having a diameter $d_1$ rolls along a base circle A having a diameter d without slipping, and a trochoidal curve TC is drawn by a point distant from the center of this rolling circle B by a distance e. Then, the tooth profile is formed by an envelope of a group of circular arcs of a locus circle C having a diameter $d_2$ and whose center is located on the trochoidal curve TC. In the following description, the distance e from the center of the rolling circle B will be referred to as a tentative amount of eccentricity between the inner rotor 2 and the outer rotor 3.

Figure 2:
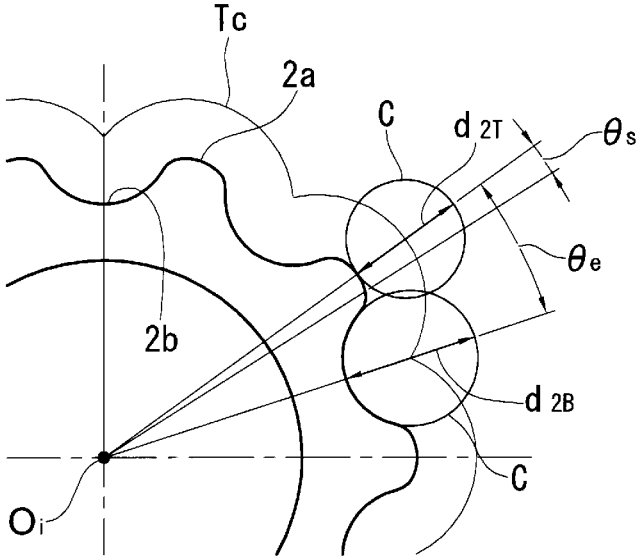
FIG. 2 illustrates a method for forming a tooth profile of an inner rotor according to the invention.

As shown in FIG. 2, with regard to the locus circle C used for drawing the envelope, a diameter $d_{2T}$ at the addendum point 2*a* of the inner rotor 2 and a diameter $d_{2B}$ at the dedendum point 2*b* are different from each other. In detail, the diameter of the locus circle C gradually increases from the addendum point 2*a* toward the dedendum point 2*b* of the inner rotor 2.

Figure 5:
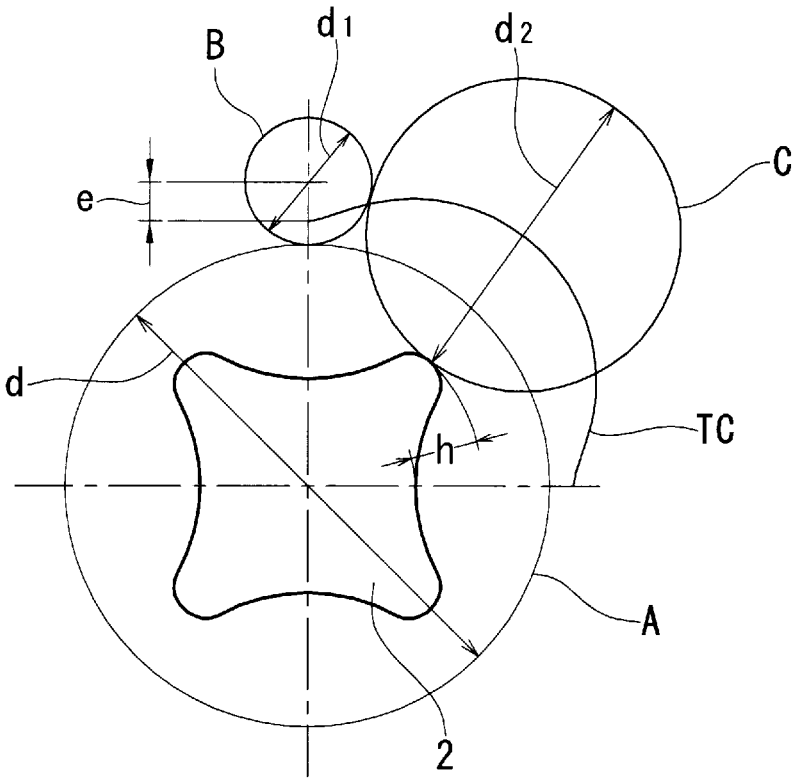
FIG. 5 is a diagram explaining a method for forming a tooth profile using a trochoidal curve.

Accordingly, a tooth height h of the inner rotor 2 is larger than the tooth height of teeth formed based on the method in FIG. 5. As a result, the capacity of a pump chamber (chamber) 4 formed between the teeth of the inner rotor 2 and the outer rotor 3 increases, so that the pump discharge rate increases.

The diameter $d_2$ of the locus circle C changes as expressed by the following expression (1):

$$d_2\theta = d_{2T} + (d_{2B} - d_{2T}) \times (\theta - \theta s)/(\theta e - \theta s) \qquad \text{Expression (1)}$$

where θ denotes an angle between the addendum point and the center of the locus circle, $d_2\theta$ denotes a diameter of the locus circle C at the angle θ, $d_{2T}$ denotes a diameter of the locus circle C at the addendum point of the inner rotor, $d_{2B}$ denotes a diameter of the locus circle C at the dedendum point of the inner rotor, θe denotes an angle between the addendum point and the dedendum point of the inner rotor and is determined from 180°/n, and θs denotes an angle from the addendum point of the inner rotor to a position where the diameter $d_2$ of the locus circle C begins to change (θe≠θs).

With regard to a ratio of the diameter $d_{2T}$ at the addendum point of the locus circle C to the diameter $d_{2B}$ at the dedendum point ($d_{2T}/d_{2B}$), a smaller value thereof allows for a larger tooth height. However, since this leads to louder gear rattling noise, the ratio may be set such that the condition $d_{2T}/d_{2B}>0.9$ is satisfied.

Furthermore, in the tooth profile formed based on the method described in claim 2 of Patent Literature 2 mentioned above, the face width of the inner rotor 2 decreases with decreasing ratio of $d_{2T}/d_{2B}$. In the rotor according to this invention, the diameter $d_2$ of the locus circle C based on Expression (1) changes from a position displaced from the addendum by a certain angle. Thus, even if the ratio of $d_{2T}/d_{2B}$ is small to a certain extent, a narrow addendum is suppressed.

In this case, as described above, the angle θs from the addendum to the position where the diameter $d_2$ of the locus circle C begins to change may be set between 5% and 40% of the angle θe between the addendum point and the dedendum point of the inner rotor (referred to as "half tooth angle" hereinafter), or more preferably, between about 10% and 20% thereof.

By setting the angle θs to 5% or higher of the half tooth angle θe, an advantage of suppressing addendum abrasion can be satisfactorily achieved. Furthermore, by setting the angle θs to 40% or lower of the half tooth angle θe, an advantage of suppressing a rapid increase in the clearance at each addendum does not need to be sacrificed. In view of the balance between the addendum-abrasion suppression effect and the noise prevention effect, an appropriate numerical value may be selected for the angle θs from a preferred range.

Figure 4:
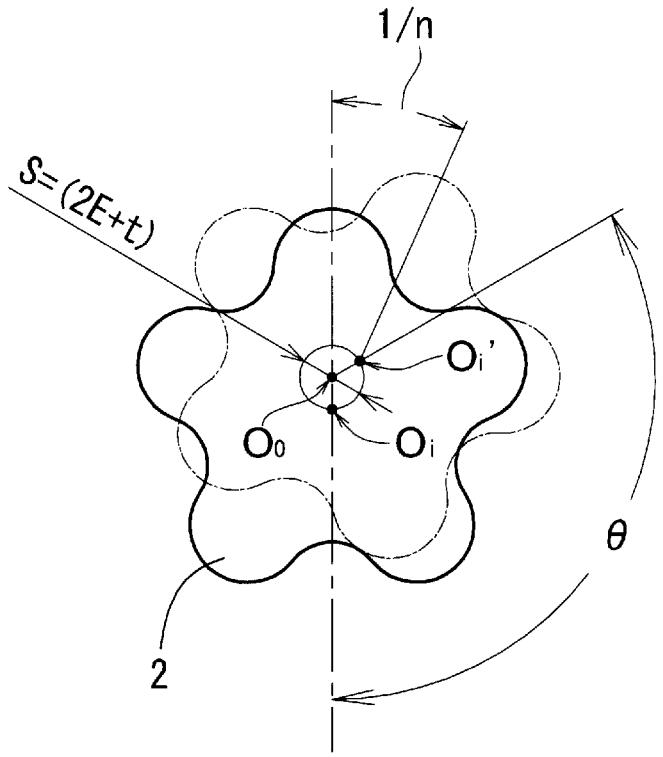
FIG. 4 illustrates a method for forming a tooth profile of an outer rotor.

The outer rotor 3 used has one tooth more than the inner rotor 2. The tooth profile of the outer rotor 3 is formed as shown in FIG. 4. Specifically, a center $O_i$ of the inner rotor 2 first makes one revolution around a circle S having a diameter (2E+t) and coaxial with a center $O_o$ of the outer rotor 3. Then, while the center $O_i$ of the inner rotor makes one revolution around the circle S, the inner rotor rotates 1/n times. An envelope of a group of tooth-profile curves of the inner rotor 2 formed in this manner serves as the tooth profile of the outer rotor 3.

In this case, E denotes an amount of eccentricity between the inner rotor and the outer rotor, t denotes a maximum clearance (=tip clearance) between the addenda of the outer rotor and the inner rotor pressed against the outer rotor, and n denotes the number of teeth of the inner rotor. The relationship between the amount E of eccentricity and the tentative amount e of eccentricity is as follows: $E=e+(d_{2B}-d_{2T})/4$.

Figure 3:
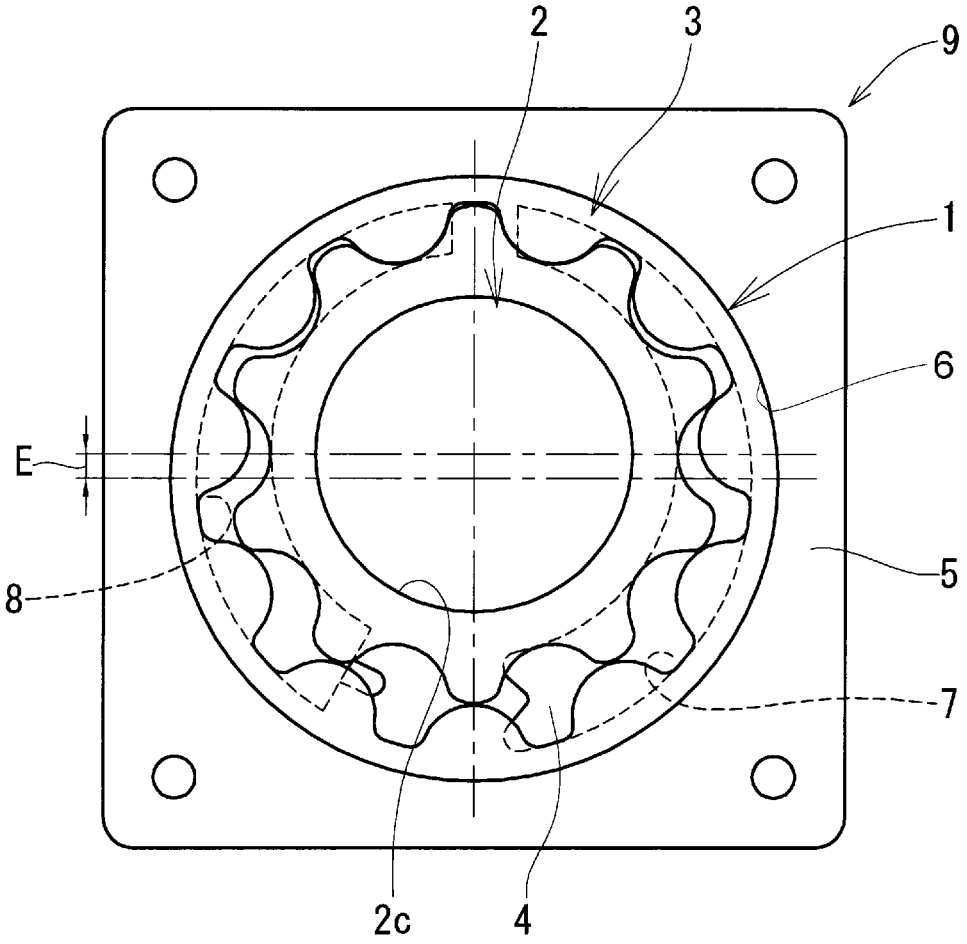
FIG. 3 is an end-surface diagram illustrating an internal gear pump equipped with the pump rotor in FIG. 1 in a state where a cover of a housing is removed therefrom.

As shown in FIG. 3, when corner sections at the opposite ends, in the rotor rotating direction, of each dedendum of the outer rotor 3 are widened in a direction away from the corresponding addendum of the inner rotor 2, a gap is formed between the addendum of the inner rotor and the dedendum of the outer rotor. This prevents gear rattling between the inner rotor 2 and the outer rotor 3, thereby further enhancing the noise reduction effect.

The pump rotor 1 is formed by combining the inner rotor 2 and the outer rotor 3 described above and disposing them eccentrically relative to each other. Then, as shown in FIG. 3, the pump rotor 1 is accommodated within a rotor chamber 6 of a pump housing 5 having an intake port 7 and a discharge port 8, whereby an internal gear pump 9 is formed.

In the internal gear pump 9, a drive shaft (not shown) is fitted through the shaft hole 2*c* of the inner rotor 2, and the inner rotor 2 rotates by receiving a drive force from the drive shaft. In this case, the outer rotor 3 is driven and rotated. This rotation causes the capacity of the pump chamber 4 formed between the two rotors to increase or decrease so that a liquid, such as oil, is injected or discharged.

EXAMPLES

Example 1

An internal gear pump having the specifications shown in Table I is designed. In sample 1 in Table I, the diameter of the locus circle C for forming the tooth profile of the inner rotor is changed from the addendum as in the rotor according to Patent Literature 2 (i.e., θs=0°), and the aforementioned ratio of $d_{2T}/d_{2B}$ is set to 0.9. Moreover, the tentative amount e of eccentricity (i.e., amount of eccentricity in design) is slightly smaller than that in sample 2.

In sample 2, $d_{2T}/d_{2B}$=0.99, and the angle from the addendum to the position where the diameter of the locus circle begins to change is set such that θs=2.5°.

The tooth profile of the outer rotor to be combined with the inner rotor is formed based on the method described with reference to FIG. 4 by using the inner rotor serving as the combination partner.

TABLE I

| Sample number | 1 | 2 |
|---|---|---|
| Number of teeth of inner rotor | 10 | 10 |
| Number of teeth of outer rotor | 11 | 11 |
| Outside diameter (mm) of outer rotor | 85 | 85 |
| Dedendum diameter (mm) of outer rotor | 76.9 | 76.9 |
| Addendum diameter (mm) of outer rotor | 73.9 | 73.9 |
| Addendum diameter (mm) of inner rotor | 70.3 | 70.3 |
| Dedendum diameter (mm) of inner rotor | 57.3 | 57.3 |
| Amount E of eccentricity (mm) | 3.25 | 3.25 |
| Diameter (mm) of base circle A for forming tooth profile | 69.2 | 71.6 |
| Diameter (mm) of rolling circle B for forming tooth profile | 6.92 | 7.16 |
| Diameter $d_{2T}$ (mm) of locus circle C at addendum point of inner rotor | 12.38 | 14.89 |
| Diameter $d_{2B}$ (mm) of locus circle C at dedendum point of inner rotor | 13.84 | 15.01 |
| $d_{2T}/d_{2B}$ | 0.90 | 0.99 |
| Tentative amount e of eccentricity (mm) | 3.105 | 3.212 |
| Angle θs (°) from addendum point of inner rotor to position where diameter $d_2$ of locus circle C begins to change | 0 | 2.5 |
| Angle θe (°) between addendum point and dedendum point of inner rotor | 18 | 18 |
| θs/θe (%) | 0 | 14 |

Next, each sample is fitted into a housing so as to form a pump. The pump is driven under the following conditions to check the occurrence of noise. The test results obtained are shown in Table II and Table III.

Test Conditions

Rotation speed of pump: 1000 rpm to 4000 rpm

Oil used: Engine oil SAE 30

Oil temperature: 80° C.

Discharge pressure: 0.5 MPa and 1.0 MPa

TABLE II

| Discharge pressure: 0.5 MPa (unit: dB) | | |
|---|---|---|
| Sample number | 1 | 2 |
| 1,000 rpm | 77.4 | 77.3 |
| 2,000 rpm | 80.6 | 79.4 |
| 3,000 rpm | 81.7 | 78.8 |
| 4,000 rpm | 85.1 | 82.4 |

TABLE III

| Discharge pressure: 1.0 MPa (unit: dB) | | |
|---|---|---|
| Sample number | 1 | 2 |
| 1,000 rpm | 81.1 | 74.3 |
| 2,000 rpm | 86.1 | 78.7 |
| 3,000 rpm | 83.3 | 81.3 |
| 4,000 rpm | 85.1 | 84.0 |

From these test results, it can be confirmed that it is advantageous to set the diameter of the locus circle, for forming the tooth profile of the inner rotor, constant until one point between the addendum point and the dedendum point of the inner rotor and then to change the diameter of the locus circle such that the diameter $d_{2B}$ at the dedendum point becomes larger than the diameter $d_{2T}$ at the addendum point. With this configuration, for example, a rapid increase in tooth-to-tooth clearance is suppressed, whereby noise is reduced.

Furthermore, when forming the tooth profile of the inner rotor, the diameter of the locus circle is made to change from a position displaced from the addendum point by a certain angle. Thus, the addenda of the inner rotor are thicker than those of the rotor according to Patent Literature 2 described above, thereby suppressing addendum abrasion.

Example 2

Next, an internal gear rotor with an inner rotor 2 having eight teeth and an outer rotor 3 having nine teeth is designed. The design specifications are shown in Table IV.

In each sample, $d_{2T}/d_{2B}$=0.983. The angle θs from the addendum point of the inner rotor to the position where the diameter $d_2$ of the locus circle C begins to change is changed.

The tooth profile of the outer rotor to be combined with the inner rotor is formed based on the method described with reference to FIG. 4 by using the inner rotor serving as the combination partner.

TABLE IV

| Sample number | 3 | 4 | 5 |
|---|---|---|---|
| Number of teeth of inner rotor | 8 | 8 | 8 |
| Number of teeth of outer rotor | 9 | 9 | 9 |
| Outside diameter (mm) of outer rotor | ϕ90 | ϕ90 | ϕ90 |
| Dedendum diameter (mm) of outer rotor | 82.4 | 82.4 | 82.4 |

TABLE IV-continued

| Sample number | 3 | 4 | 5 |
|---|---|---|---|
| Addendum diameter (mm) of outer rotor | 65.7 | 65.7 | 65.7 |
| Addendum diameter (mm) of inner rotor | 74.0 | 74.0 | 74.0 |
| Dedendum diameter (mm) of inner rotor | 57.3 | 57.3 | 57.3 |
| Amount E of eccentricity (mm) | 4.18 | 4.18 | 4.18 |
| Diameter (mm) of base circle A for forming tooth profile | 74.88 | 74.88 | 74.88 |
| Diameter (mm) of rolling circle B for forming tooth profile | 9.36 | 9.36 | 9.36 |
| Diameter $d_{2T}$ (mm) of locus circle C at addendum point of inner rotor | 18.41 | 18.41 | 18.41 |
| Diameter $d_{2B}$ (mm) of locus circle C at dedendum point of inner rotor | 18.73 | 18.73 | 18.73 |
| $d_{2T}/d_{2B}$ | 0.983 | 0.983 | 0.983 |
| Tentative amount e of eccentricity (mm) | 4.1 | 4.1 | 4.1 |
| Angle θs (°) from addendum point of inner rotor to position where diameter $d_2$ of locus circle C begins to change | 0 | 3 | 9 |
| Angle θe (°) between addendum point and dedendum point of inner rotor | 22.5 | 22.5 | 22.5 |
| θs/θe (%) | 0 | 13 | 40 |

Next, each sample is fitted into a housing so as to form a pump. The pump is driven under the following conditions to check the occurrence of noise. The test results obtained are shown in Table V.

Test Conditions

Rotation speed of pump: 1000 rpm to 4000 rpm
Oil used: Engine oil SAE 30
Oil temperature: 80° C.
Discharge pressure: 0.5 MPa

TABLE V

Discharge pressure: 0.5 MPa (unit dB)

| Sample number | 3 | 4 | 5 |
|---|---|---|---|
| 1,000 rpm | 78.9 | 78.8 | 78.3 |
| 2,000 rpm | 82.2 | 81.0 | 80.4 |
| 3,000 rpm | 83.3 | 80.4 | 79.7 |
| 4,000 rpm | 86.8 | 84.0 | 83.2 |

From these test results, it can be confirmed that it is advantageous to set the diameter of the locus circle, for forming the tooth profile of the inner rotor, constant until one point between the addendum point and the dedendum point of the inner rotor and then to change the diameter of the locus circle such that the diameter $d_{2B}$ at the dedendum point becomes larger than the diameter $d_{2T}$ at the addendum point. With this configuration, for example, a rapid increase in the tooth-to-tooth clearance is suppressed, whereby noise is reduced.

The embodiment disclosed this time is merely an example in all aspects and should not be considered as being limitative. The scope of this invention is intended to include all modifications that are defined within the scope of the claims or within a scope equivalent to the scope of the claims.

REFERENCE SIGNS LIST

1 pump rotor
2 inner rotor
2*a* addendum point
2*b* dedendum point
2*c* shaft hole
3 outer rotor
4 pump chamber
5 pump housing
6 rotor chamber
7 intake port
8 discharge port
9 internal gear pump
A base circle
B rolling circle
C locus circle
TC trochoidal curve
S circle having diameter (2E+t)
d diameter of base circle A
$d_1$ diameter of rolling circle B
$d_2$ diameter of locus circle C
h tooth height of inner rotor
$O_i$ center of inner rotor
$O_o$ center of outer rotor
e tentative amount of eccentricity between inner rotor and outer rotor
E amount of eccentricity between inner rotor and outer rotor
t maximum clearance (=tip clearance) between teeth of outer rotor and inner rotor pressed against outer rotor
n number of teeth of inner rotor
θ angle between addendum point and center of locus circle
$d_2\theta$ diameter of locus circle C at angle θ
$d_{2T}$ diameter of locus circle C at addendum point of inner rotor
$d_{2B}$ diameter of locus circle C at dedendum point of inner rotor
θe angle between addendum point and dedendum point of inner rotor and determined from 180°/n
θs angle from addendum point of inner rotor to position where diameter $d_2$ of locus circle C begins to change (θe≠θs)

The invention claimed is:

1. An internal-gear-pump rotor comprising:

an inner rotor having n gear teeth and an outer rotor having (n+1) gear teeth, wherein when a rolling circle having a diameter $d_1$ is rolled along a base circle having a diameter d without slipping and a trochoidal curve is drawn by a point distant from a center of the rolling circle by a distance e, a tooth profile of the inner rotor is formed by an envelope of a group of circular arcs of a locus circle (C) having a diameter $d_2$ and having a center on the trochoidal curve, wherein the diameter $d_2$ of the locus circle C is constant until one point between an addendum point and a dedendum point of the inner rotor and changes from the one point such that a diameter $d_{2B}$ at the dedendum point becomes larger than a diameter $d_{2T}$ at the addendum point, and wherein the diameter $d_2$ of the locus circle C changes as expressed by Expression (1) below:

$$d_2\theta = d_{2T} + (d_{2B} - d_{2T}) \times (\theta - \theta s)/(\theta e - \theta s) \quad \text{Expression (1)}$$

where θ denotes an angle between the addendum point and the center of the locus circle, $d_2\theta$ denotes a diameter of the locus circle C at the angle θ, $d_{2T}$ denotes a diameter of the locus circle C at the addendum point of the inner rotor, $d_{2B}$ denotes a diameter of the locus circle C at the dedendum point of the inner rotor, θe denotes an angle between the addendum point and the dedendum point of the inner rotor and is determined from 180°/n, and θs denotes an angle from the addendum point of the inner rotor to a position where the diameter $d_2$ of the locus circle C begins to change (θe≠θs).

2. The pump rotor according to claim 1, wherein an angle θs from the addendum point to a position where the diameter $d_2$ of the locus circle C begins to change is set between 5% and 40% of an angle θe between the addendum point and the dedendum point of the inner rotor.

3. The pump rotor according to claim 1, wherein a ratio of a diameter $d_{2T}$ of the locus circle C at the addendum point of the inner rotor to a diameter $d_{2B}$ at the dedendum point satisfies a condition $d_{2T}/d_{2B} > 0.9$.

4. An internal gear pump formed by accommodating a pump rotor within a rotor chamber provided in a housing, the pump rotor being formed by combining an inner rotor having a tooth profile according to claim 1 with an outer rotor whose tooth profile is formed by an envelope of a group of tooth-profile curves of the inner rotor, the envelope of the group of tooth-profile curves being formed by revolving a center of the inner rotor around a circle having a diameter (2E+t) and coaxial with a center of the outer rotor, and rotating the inner rotor 1/n times while the center of the inner rotor makes one revolution around the circle, where E denotes an amount of eccentricity between the inner rotor and the outer rotor, t denotes a maximum clearance between addenda of the outer rotor and the inner rotor pressed against the outer rotor, and n denotes the number of teeth of the inner rotor.

* * * * *